US008847494B2

(12) United States Patent
Kameda et al.

(10) Patent No.: US 8,847,494 B2
(45) Date of Patent: Sep. 30, 2014

(54) IGNITION SYSTEM FOR PLASMA JET IGNITION PLUG

(75) Inventors: Hiroyuki Kameda, Aichi-ken (JP); Daisuke Nakano, Kiyosu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 94 days.

(21) Appl. No.: 13/310,080

(22) Filed: Dec. 2, 2011

(65) Prior Publication Data

US 2012/0169244 A1 Jul. 5, 2012

(30) Foreign Application Priority Data

Jan. 4, 2011 (JP) ..... 2011-22
Apr. 4, 2011 (JP) ..... 2011-82366

(51) Int. Cl.

| | |
|---|---|
| ***H01J 7/24*** | (2006.01) |
| ***F02P 9/00*** | (2006.01) |
| ***F02P 23/04*** | (2006.01) |
| ***H01T 13/50*** | (2006.01) |

(52) U.S. Cl.

CPC ..... *F02P 9/007* (2013.01); *F02P 23/045* (2013.01); *H01T 13/50* (2013.01)
USPC ..... 315/111.21; 315/111.41; 315/111.51; 315/111.81; 315/209 T

(58) Field of Classification Search

USPC ..... 315/111.21–81, 135, 209 T, 315/111.21–111.81
See application file for complete search history.

(56) References Cited

U.S. PATENT DOCUMENTS 3,467,471 A * 9/1969 Berry et al. ..... 356/36
6,131,542 A * 10/2000 Suckewer et al. ..... 123/143 B
6,559,376 B2 5/2003 Funk et al. ..... 174/28
6,662,793 B1 * 12/2003 Allen et al. ..... 123/620
7,328,677 B2 * 2/2008 Hagiwara et al. ..... 123/143 B
7,401,603 B1 * 7/2008 Lepley ..... 123/605
7,714,488 B2 * 5/2010 Nagasawa et al. ..... 313/130
7,827,954 B2 * 11/2010 Nagasawa et al. ..... 123/143 B (Continued)

FOREIGN PATENT DOCUMENTS

JP 55-7952 1/1980 ..... F02P 23/04
JP 9-68149 3/1997 ..... F02P 15/00

(Continued)

OTHER PUBLICATIONS

Notification of Reason for Refusal (dated Jul. 31, 2012) issued in connection with corresponding Japanese Patent Application No. 2011-082366, with English translation.

(Continued)

*Primary Examiner* — Douglas W Owens
*Assistant Examiner* — Srinivas Sathiraju
(74) *Attorney, Agent, or Firm* — Kusner & Jaffe

(57) ABSTRACT

An ignition system for a plasma jet ignition plug that enables a reduction in production cost and provides excellent ignition performance through improvement of plasma formation efficiency. The ignition system includes a plasma jet ignition plug having a center electrode, a ground electrode, and a cavity surrounding at least a portion of a gap formed between the center electrode and the ground electrode to form a discharge space, and a voltage application section for applying voltage across the gap. The ignition system further includes a capacitance section having a capacitance and provided in parallel with the plasma jet ignition plug between the plasma jet ignition plug and the voltage application section.

11 Claims, 9 Drawing Sheets

(56) References Cited

U.S. PATENT DOCUMENTS

| | | | | |
|---|---|---|---|---|
| 7,895,994 | B2 * | 3/2011 | Yamada et al. | 123/618 |
| 8,044,319 | B2 * | 10/2011 | Prociw et al. | 219/121.57 |
| 8,047,172 | B2 * | 11/2011 | Nakamura et al. | 123/143 B |
| 8,196,557 | B2 * | 6/2012 | Kameda et al. | 123/143 B |
| 8,237,342 | B2 * | 8/2012 | Yamamura et al. | 313/141 |
| 8,242,672 | B2 * | 8/2012 | Kuribayashi et al. | 313/134 |
| 8,257,127 | B2 * | 9/2012 | Nakamura et al. | 445/7 |
| 8,267,075 | B2 * | 9/2012 | Kobayashi | 123/647 |
| 2008/0141967 | A1 * | 6/2008 | Tani et al. | 123/143 B |
| 2011/0197865 | A1 * | 8/2011 | Hampton | 123/623 |
| 2011/0254429 | A1 * | 10/2011 | Kameda et al. | 313/141 |
| 2011/0297131 | A1 | 12/2011 | Nakano et al. | 123/596 |

FOREIGN PATENT DOCUMENTS

| | | | |
|---|---|---|---|
| JP | 03534708 | 3/2004 | F02P 15/00 |
| JP | 2004-239150 | 8/2004 | F02P 15/00 |
| JP | 2010-218768 | 9/2010 | H01T 13/52 |
| WO | WO2010/095694 | 8/2010 | H01T 15/00 |

OTHER PUBLICATIONS

Notification of Reason for Refusal (dated Apr. 3, 2012) issued in connection with corresponding Japanese Patent Application No. 2011-082366, with English translation.

* cited by examiner

IGNITION SYSTEM FOR PLASMA JET IGNITION PLUG

FIELD OF THE INVENTION

The present invention relates to an ignition system for a plasma jet ignition plug for igniting an air-fuel mixture or the like through generation of plasma.

BACKGROUND OF THE INVENTION

Conventionally, a combustion apparatus, such as an internal combustion engine, uses a spark plug for igniting an air-fuel mixture through spark discharge. In recent years, in order to meet demand for high output and low fuel consumption of the combustion apparatus, a plasma jet ignition plug has been proposed, since the plasma jet ignition plug provides quick propagation of combustion and can more reliably ignite even a lean air-fuel mixture having a higher ignition-limit air-fuel ratio.

Generally, the plasma jet ignition plug includes a tubular insulator having an axial bore, a center electrode inserted into the axial bore in such a manner that a forward end surface thereof is recessed from a forward end surface of the insulator, a metallic shell disposed externally of the outer circumference of the insulator, and an annular ground electrode joined to a forward end portion of the metallic shell. Also, the plasma jet ignition plug has a hollow space (cavity) defined by the forward end surface of the center electrode and a wall surface of the axial bore. The cavity communicates with an ambient atmosphere via a through hole formed in the ground electrode.

Such plasma jet ignition plug ignites an air-fuel mixture as follows. First, voltage is applied across a gap formed between the center electrode and the ground electrode, thereby generating spark discharge across the gap and thus causing dielectric breakdown in the gap. In this condition, electric power is input to the gap, thereby bringing gas in the cavity into the plasma state; i.e., generating plasma within the cavity. The generated plasma is discharged through an opening of the cavity, thereby igniting the air-fuel mixture.

In order to generate plasma in the plasma jet ignition plug, a general ignition system for the plasma jet ignition plug includes a voltage application section for applying voltage across the gap to generate spark discharge, and an electric power input section for inputting electric power to the gap. Also, diodes are provided respectively between the plasma jet ignition plug and the voltage application section and between the plasma jet ignition plug and the electric power input section, so as to prevent flow of current from one of the voltage application section and the electric power input section to the other. For example, refer to Japanese Patent Application Laid-Open (kokai) No. 2010-218768 ("Patent Document 1").

SUMMARY OF THE INVENTION

Problems to be Solved by the Invention

As in the case of the above technique, provision of at least two diodes in addition to the voltage application section and the electric power input section may greatly increase the production cost of the ignition system. Also, the diode provided between the plasma jet ignition plug and the electric power input section may restrain resonance of electric power supplied from the electric power input section, potentially resulting in a reduction in energy which is input to the gap.

Furthermore, according to the above technique, in generation of spark discharge through application of voltage, subsequent to capacitive discharge, which involves abrupt variation in voltage, inductive discharge, which involves continuous flow of a very small current, is generated. In order to promote bringing gas into the plasma state for enhancing plasma formation efficiency, increasing current which flows in association with capacitive discharge is important. According to the above technique, energy associated with inductive discharge is wasted, potentially resulting in a deterioration in energy efficiency.

The present invention has been conceived in view of the above circumstances, and an object of the invention is to provide an ignition system for a plasma jet ignition plug which enables a great reduction in production cost and can implement excellent ignition performance through improvement of plasma formation efficiency.

Means for Solving the Problems

Configurations suitable for achieving the above object will next be described in itemized form. If needed, actions and effects peculiar to the configurations will be described additionally.

Configuration 1: An ignition system for a plasma jet ignition plug of the present configuration comprises a plasma jet ignition plug having a center electrode, a ground electrode, and a cavity surrounding at least a portion of a gap formed between the center electrode and the ground electrode to form a discharge space; a voltage application section for applying voltage across the gap; and a capacitance section having a capacitance and provided in parallel with the plasma jet ignition plug between the plasma jet ignition plug and the voltage application section.

According to the above configuration 1, the capacitance section having a capacitance is provided in parallel with the plasma jet ignition plug. Thus, when the voltage application section applies voltage across the gap, both of the ignition plug and the capacitance section are supplied with charge. When the potential difference at the gap exceeds the dielectric breakdown voltage of the gap, charge stored in the ignition plug as well as charge stored in the capacitance section flow into the gap, thereby generating capacitive discharge. Therefore, current which flows in association with capacitive discharge can be increased, whereby plasma formation efficiency can be improved.

Furthermore, since, upon generation of capacitive discharge, the resistance of the gap drops, there is concern that current flows into the gap from the voltage application section with resultant generation of inductive discharge. However, according to the above configuration 1, current from the voltage application section flows into the capacitance section for charging the capacitance section. Therefore, energy which is conventionally used for inductive discharge can be utilized as energy of the capacitance section for use in capacitive discharge. As a result, a decrease in energy efficiency can be restrained, whereby plasma formation efficiency can be further improved.

Additionally, the above configuration 1 does not require an electric power input section for inputting electric power and diodes for preventing current from flowing into the voltage application section, etc. Also, a reduction in energy input to the gap caused by presence of a diode can be prevented.

As mentioned above, according to the above configuration 1, the electric power input section and diodes can be eliminated. Also, even though the electric power input section is eliminated, by virtue of presence of the capacitance section and elimination of diodes, plasma formation efficiency can be effectively improved. As a result, while production cost is greatly reduced, excellent ignition performance can be implemented.

Configuration 2: An ignition system for a plasma jet ignition plug of the present configuration is characterized in that, in the above configuration 1, the capacitance of the capacitance section is equal to or greater than that of the plasma jet ignition plug.

Generally, capacitive discharge continues only for a short period of time. However, if, upon completion of charging the capacitance section, capacitive discharge is still under way, current flows into the gap whose resistance has decreased in association with capacitive discharge, potentially resulting in generation of inductive discharge.

In this regard, according to the above configuration 2, the capacitance of the capacitance section is specified to be equal to or greater than that of the plasma jet ignition plug. Accordingly, charging the capacitance section consumes time. At the time of completion of charging the capacitance section, capacitive discharge can be readily halted (i.e., upon completion of charging the capacitive section and upon associated establishment of a state in which current from the voltage application section and the capacitance section can flow into the gap, the resistance of the gap is more reliably restored to the original level). Thus, there can be more reliably prevented flow of current into the gap from the voltage application section and the capacitance section and associated generation of inductive discharge. Therefore, plasma formation efficiency can be further improved.

Configuration 3: An ignition system for a plasma jet ignition plug of the present configuration is characterized in that, in the above configuration 1 or 2, the capacitance section has a capacitor electrically connected to a line between the plasma jet ignition plug and the voltage application section.

According to the above configuration 3, the capacitance of the capacitance section can be more reliably and more readily increased, so that actions and effects of the above configurations 1 and 2 can be more reliably exhibited.

Configuration 4: An ignition system for a plasma jet ignition plug of the present configuration is characterized in that, in any one of the above configurations 1 to 3, the capacitance section has a capacitance of 500 pF or less.

According to the above configuration 4, discharge energy associated with discharge of charge accumulated in the capacitance section can be sufficiently reduced. Therefore, thermal erosion or the like of the center electrode associated with discharge can be restrained, so that durability can be improved. As a result, the above-mentioned excellent ignition performance can be maintained over a long period of time.

Configuration 5: An ignition system for a plasma jet ignition plug of the present configuration is characterized in that, in any one of the above configurations 1 to 4, a current path extending from the capacitance section to a forward end of the center electrode has a resistance of 500Ω or less.

When the current path extending from the capacitance section to the forward end of the center electrode has an excessively large resistance, charge stored in the capacitance section may flow into the gap an excessively long time after charge stored in the ignition plug has flowed into the gap. In this case, capacitive discharge may be generated only with charge of the ignition plug, whereas charge of the capacitance section may generate inductive discharge. Thus, current which flows in association with capacitive discharge may be reduced.

In this regard, according to the above configuration 5, the current path extending from the capacitance section to the forward end of the center electrode has a resistance of 500Ω or less. Therefore, charge stored in the capacitance section flows into the gap not a long time after charge stored in the ignition plug has flowed into the gap. Thus, capacitive discharge can be more reliably generated with both of charge stored in the ignition plug and charge stored in the capacitance section. As a result, current which flows in association with capacitive discharge can be more reliably increased, so that plasma formation efficiency can be further improved.

Configuration 6: An ignition system for a plasma jet ignition plug of the present configuration is characterized in that, in any one of the above configurations 1 to 5, a current path extending from the capacitance section to a forward end of the center electrode has a resistance of 1Ω or greater.

As mentioned above, in order to increase current which flows in association with capacitive discharge, preferably, the current path extending from the capacitance section to the forward end of the center electrode is reduced in resistance. However, when the resistance is reduced excessively, inputting time of electric power to the gap from the ignition plug and the capacitance section becomes excessively short, potentially resulting in an excessive increase in plasma discharge speed. In this case, difficulty is encountered in transmitting heat of plasma to an air-fuel mixture, potentially resulting in a failure to sufficiently improve ignition performance.

In this regard, according to the above configuration 6, the current path has a resistance of 1Ω or greater. Therefore, an excessive increase in plasma discharge speed can be restrained, so that heat of plasma can be efficiently transmitted to the air-fuel mixture. As a result, the above-mentioned effect of improving ignition performance can be more reliably exhibited.

Configuration 7: An ignition system for a plasma jet ignition plug of the present configuration is characterized in that, in any one of the above configurations 1 to 6, the relational expression $0.5\times C\times V^2\leq E\times 0.8$ is satisfied, where V (V) is the dielectric breakdown voltage of the gap, C (F) is the total of the capacitance of the capacitance section and the capacitance of the plasma jet ignition plug, and E (J) is energy supplied to the gap from the voltage application section.

According to the above configuration 7, electric energy ($0.5\times C\times V^2$) which can be stored in the capacitance section and the ignition plug is specified to a sufficiently small value of 0.8 times or less the energy supplied from the voltage application section. Therefore, the ignition plug can be supplied with sufficient charge, so that capacitive discharge can be more reliably generated. As a result, the above-mentioned effect of improving ignition performance can be further reliably exhibited.

Configuration 8: An ignition system for a plasma jet ignition plug of the present configuration is characterized in that, in any one of the above configurations 1 to 7, the relational expression $E\times 0.05\leq 0.5\times C\times V^2\leq E\times 0.3$ is satisfied, where V (V) is the dielectric breakdown voltage of the gap, C (F) is the total of the capacitance of the capacitance section and the capacitance of the plasma jet ignition plug, and E (J) is energy supplied to the gap from the voltage application section.

According to the above configuration 8, electric energy ($0.5\times C\times V^2$) which can be stored in the capacitance section and the ignition plug is specified to a value of 0.05 times to 0.3 times, inclusive, the energy supplied from the voltage application section. Therefore, by use of energy of single supply, capacitive discharge can be more reliably generated a plurality of times (about three times to 20 times), so that plasma generation efficiency can be further effectively improved. As a result, ignition performance can be further improved.

Configuration 9: An ignition system for a plasma jet ignition plug of the present configuration is characterized in that: in any one of the above configurations 1 to 8, the capacitance section comprises a variable capacitor capable of varying its own capacitance, and the ignition system further comprises a controller capable of controlling the capacitance of the variable capacitor on the basis of the dielectric breakdown voltage of the gap.

In association with variation in dielectric breakdown voltage of the gap stemming from, for example, operating conditions of a combustion apparatus and the expansion of the gap, energy required for capacitive discharge varies. According to the above configuration 9, the capacitance of the variable capacitor and, in turn, the capacitance of the capacitance section can be varied on the basis of the dielectric breakdown voltage of the gap. Therefore, even when the dielectric breakdown voltage of the gap varies, by means of the capacitance of the capacitance section being varied according to the variation of the dielectric breakdown voltage, for example, in such a manner as to satisfy the above configurations 7 and 8, actions and effects of the above configurations 7 and 8 can be more reliably exhibited.

Configuration 10: An ignition system for a plasma jet ignition plug of the present configuration is characterized in that: in any one of the above configurations 1 to 9, the ignition system further comprises a plug cap unit that has an electrical conductor electrically connecting the plasma jet ignition plug and a plug cord to which voltage from the voltage application section is applied and that is connected to the plasma jet ignition plug, and the capacitance section comprises a unit built-in section which has a capacitance equal to or greater than that of the plasma jet ignition plug and which is built into the plug cap unit.

As in the case of the above configuration 10, the plug cap unit may be provided in the ignition system, and the unit built-in section having a capacitance equal to or greater than that of the ignition plug may be provided within the plug cap unit. In this case, actions and effects similar to those of the above configuration 2, etc., are yielded.

Configuration 11: An ignition system for a plasma jet ignition plug of the present configuration is characterized in that, in the above configuration 10, the unit built-in section is covered with a covering member formed of an insulating material.

According to the above configuration 11, the unit built-in section is covered with the covering member formed of an insulating material. Therefore, deterioration in insulating properties of the unit built-in section caused by adhesion of, for example, dust and water droplets can be restrained, and current leakage from the unit built-in section can be more reliably prevented. As a result, loss in energy supplied to the ignition plug from the unit built-in section (the capacitance section) can be effectively restrained, so that ignition performance can be further improved.

Configuration 12: An ignition system for a plasma jet ignition plug of the present configuration is characterized in that, in the above configuration 10 or 11, the capacitance section is connected at one end to the electrical conductor and is grounded at the other end, a shield formed of a conductive material is disposed around the unit built-in section and the electrical conductor, and the shield is grounded.

According to the above configuration 12, the unit built-in section and the electrical conductor are surrounded by the shield which is grounded, similar to the other end of the capacitance section. Therefore, the shield functions as a noise shield, thereby more reliably preventing outward release of noise generated when charge stored in the capacitance section flows into the ignition plug.

Configuration 13: An ignition system for a plasma jet ignition plug of the present configuration is characterized in that, in the above configuration 12, the capacitance between the shield and the electrical conductor is 25 pF or less.

According to the above configuration 13, the capacitance between the shield and the electrical conductor is 25 pF or less. Therefore, noise generated when charge stored between the shield and the electrical conductor flows into the ignition plug can be sufficiently reduced.

Configuration 14: An ignition system for a plasma jet ignition plug of the present configuration is characterized in that: in any one of the above configurations 10 to 13, the capacitance section is connected at one end to the electrical conductor; a connection between the electrical conductor and the one end of the capacitance section is disposed in the vicinity of an end portion of the electrical conductor which is connected to the plasma jet ignition plug; and a resistor having a resistance of 500Ω or greater intervenes between the connection and an end portion of the electrical conductor which is connected to the plug cord.

The expression "a connection . . . is disposed in the vicinity of an end portion of the electrical conductor which is connected to the plasma jet ignition plug" means that the connection is disposed on a side toward an end portion of the electrical conductor which is connected to the ignition plug, with respect to the middle position between the end portion of the electrical conductor which is connected to the plug cord, and the end portion of the electrical conductor which is connected to the ignition plug.

According to the above configuration 14, the resistor having a resistance of 500Ω or greater intervenes between the connection of the electrical conductor and the capacitance section, and the end portion of the electrical conductor on a side toward the plug cord. Therefore, there can be restrained upstream propagation (propagation toward the voltage application section) of noise which is generated in the ignition plug in association with capacitive discharge, so that a noise-restraining effect can be further enhanced. Also, the presence of the resistor can prevent charge stored between the shield and a portion of the electrical conductor located upstream of the resistor from flowing into the ignition plug. As a result, the noise-restraining effect can be further improved.

Also, according to the above configuration 14, the connection is provided in the vicinity of an end portion of the electrical conductor on the side toward the ignition plug, and, in turn, the resistor can be provided in the vicinity of the ignition plug. Through provision of the resistor in the vicinity of the ignition plug, there can be prevented the flow, into the ignition plug, of most of the charge stored between the electrical conductor and the shield. As a result, the noise-restraining effect can be far more improved.

Additionally, since the resistor is provided in the electrical conductor at a position located upstream of the connection between the electrical conductor and the capacitance section (i.e., the resistor is not disposed on a path for supplying electric power to the ignition plug from the capacitance section), hindrance to energy input to the ignition plug from the capacitance section can be prevented which would otherwise result from the presence of the resistor.

DETAILED DESCRIPTION OF THE INVENTION

Figure 1:
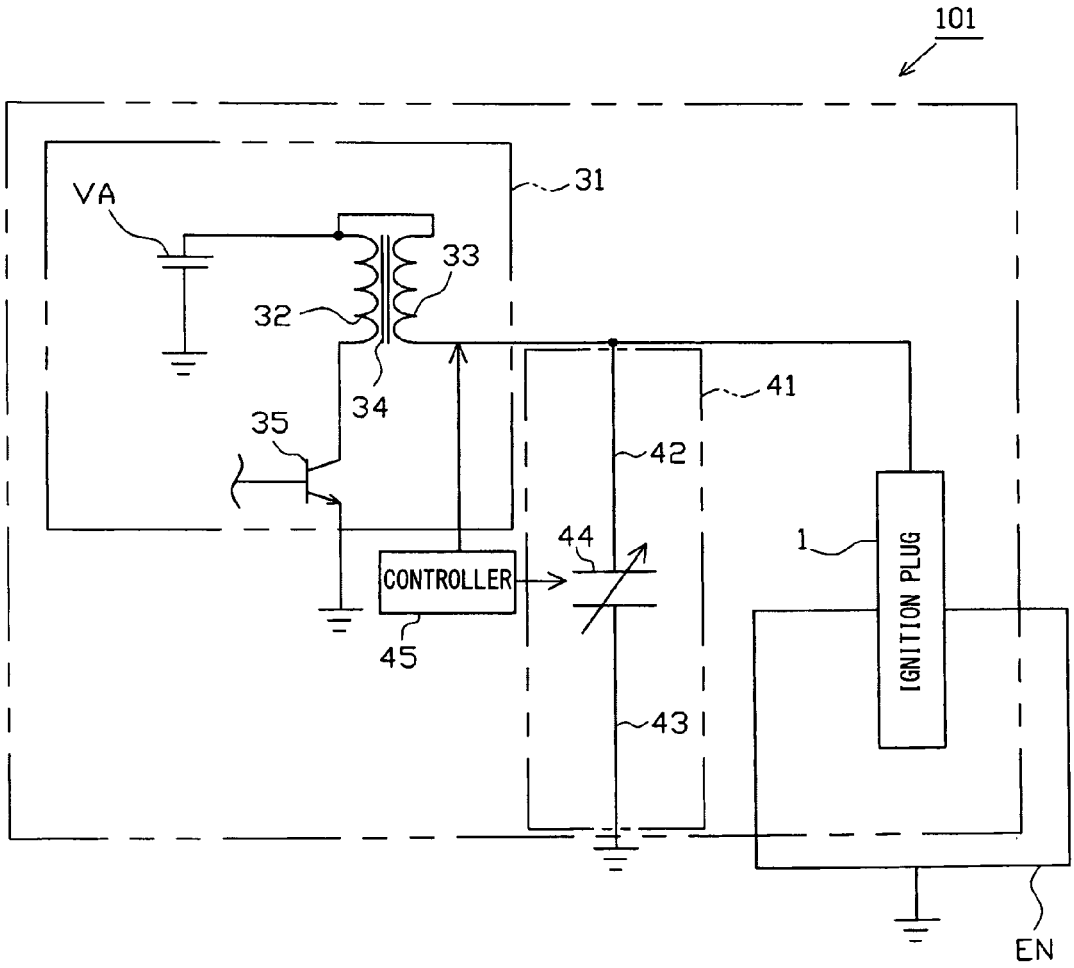
FIG. 1 is a block diagram showing the schematic configuration of an ignition system.

An embodiment of the present invention will next be described with reference to the drawings. FIG. 1 is a block diagram showing the schematic configuration of an ignition system 101 having a plasma jet ignition plug (hereinafter, referred to as the "ignition plug") 1, a voltage application section 31, and a capacitance section 41. FIG. 1 shows only a single ignition plug 1. However, an internal combustion engine EN has a plurality of cylinders, and the ignition plugs 1 are provided for the respective cylinders. The voltage application section 31 and the capacitance section 41 are provided for each of the ignition plugs 1.

Prior to the description of the ignition system 101, the schematic configuration of the ignition plug 1 will be described.

Figure 2:
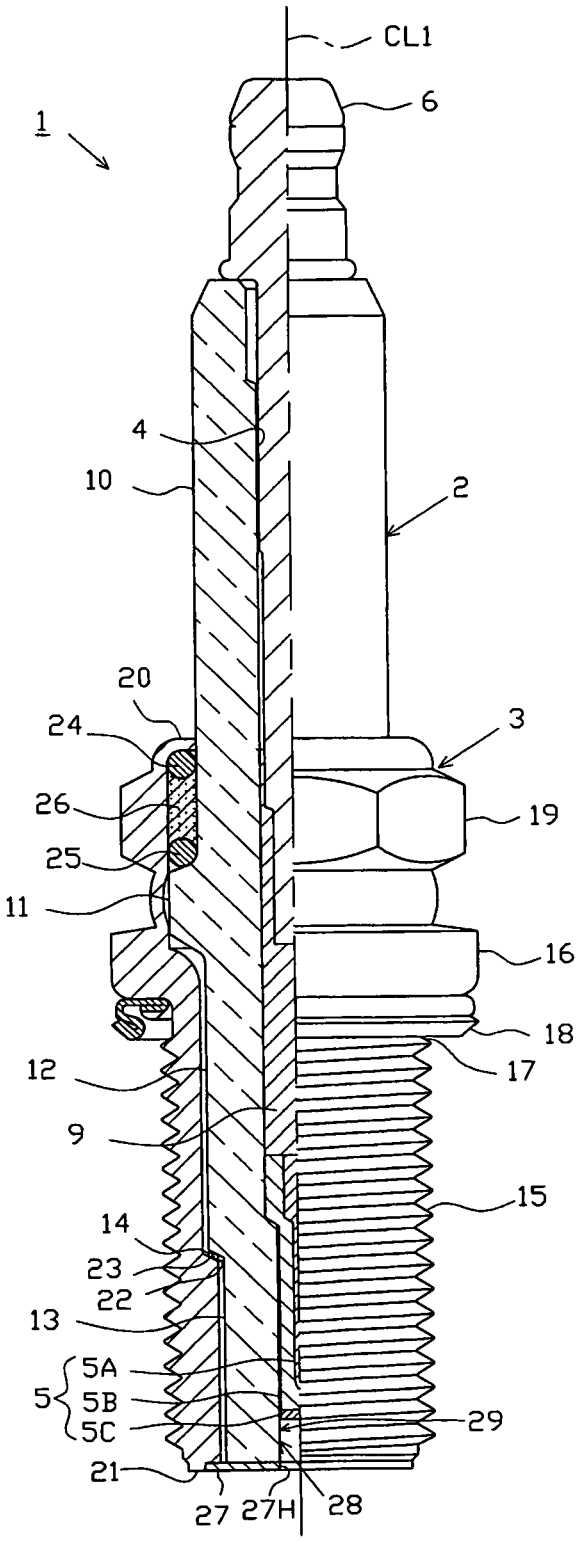
FIG. 2 is a partially cutaway front view showing the configuration of the ignition plug.

FIG. 2 is a partially cutaway front view showing the ignition plug 1. In FIG. 2, the direction of an axis CL1 of the ignition plug 1 is referred to as the vertical direction. In the following description, the lower side of the spark plug 1 in FIG. 2 is referred to as the forward side of the spark plug 1, and the upper side as the rear side.

The ignition plug 1 includes a tubular insulator 2 and a tubular metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Additionally, the large-diameter portion 11, the intermediate trunk portion 12, and the leg portion 13 of the insulator 2 are accommodated within the metallic shell 3. A tapered, stepped portion 14 is formed at a connection portion between the intermediate trunk portion 12 and the leg portion 13. The insulator 2 is seated on the metallic shell 3 at the stepped portion 14.

Furthermore, the insulator 2 has an axial bore 4 extending therethrough along the axis CL1. A center electrode 5 is fixedly inserted into a forward end portion of the axial bore 4. The center electrode 5 includes an inner layer 5A made of, for example, copper or a copper alloy, which has excellent thermal conductivity, and an outer layer 5B made of a nickel alloy (e.g. INCONEL 600 or 601 (trade name)) which contains nickel (Ni) as a main component. Furthermore, the center electrode 5 assumes a rodlike (circular columnar) shape as a whole. The forward end surface of the center electrode 5 is disposed rearward of the forward end surface of the insulator 2. Additionally, a portion of the center electrode 5 which extends at least 0.3 mm rearward with respect to the direction of the axis CL1 from the forward end of the center electrode 5 is an electrode tip 5C formed of tungsten (W), iridium (Ir), platinum (Pt), nickel (Ni), or an alloy which contains at least one of these metals as a main component.

Also, a terminal electrode 6 is fixedly inserted into a rear end portion of the axial bore 4 and projects from the rear end of the insulator 2.

A circular columnar glass seal 9 is disposed between the center electrode 5 and the terminal electrode 6. The glass seal 9 electrically connects the center electrode 5 and the terminal electrode 6 together and fixes the center electrode 5 and the terminal electrode 6 to the insulator 2.

Additionally, the metallic shell 3 is formed into a tubular shape from a low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimp portion 20 provided at a rear end portion thereof for retaining the insulator 2. Furthermore, the metallic shell 3 has an annular engagement portion 21 formed externally at a forward end portion thereof and projecting forward with respect to the direction of the axis CL1. The ground electrode 27, which will be described later, is joined to the engagement portion 21. The center electrode 5 and the metallic shell 3 face each other with the insulator 2 intervening therebetween. This configuration is of, so to speak, a capacitor and can store charge. The ignition plug 1 has capacitance according to the facing area between the center electrode 5 and the metallic shell 3, the material of the insulator 2, etc.

Also, the metallic shell 3 has, on its inner circumferential surface, a tapered, stepped portion 22 adapted to allow the insulator 2 to be seated thereon. The insulator 2 is inserted forward into the metallic shell 3 from the rear end of the metallic shell 3. In a state in which the stepped portion 14 of the insulator 2 butts against the stepped portion 22 of the metallic shell 3, a rear-end opening portion of the metallic shell 3 is crimped radially inward; i.e., the crimp portion 20 is formed, whereby the insulator 2 is fixed to the metallic shell 3. An annular sheet packing 23 intervenes between the stepped portions 14 and 22 of the insulator 2 and the metallic shell 3, respectively. This retains gastightness of a combustion chamber and prevents outward leakage of fuel gas through a clearance between the leg portion 13 of the insulator 2 and the inner circumferential surface of the metallic shell 3.

Furthermore, in order to ensure gastightness which is established by crimping, annular ring members 24 and 25 intervene between the metallic shell 3 and the insulator 2 in a region near the rear end of the metallic shell 3, and a space between the ring members 24 and 25 is filled with a powder of talc 26. That is, the metallic shell 3 holds the insulator 2 via the sheet packing 23, the ring members 24 and 25, and the talc 26.

The ground electrode 27 assumes the form of a disk and is located forward of the forward end of the insulator 2 with respect to the direction of the axis CL1. The ground electrode 27 is joined to a forward end portion of the metallic shell 3 as follows: while the ground electrode 27 is engaged with the engagement portion 21 of the metallic shell 3, an outer circumferential portion of the ground electrode 27 is welded to the engagement portion 21. In the present embodiment, the ground electrode 27 is formed of W, Ir, Pt, Ni, or an alloy which contains at least one of these metals as a main component.

Additionally, the ground electrode 27 has a through hole 27H which extends through a central portion thereof in the thickness direction. The wall surface of the axial bore 4 and the forward end surface of the center electrode 5 define a cavity 28, which is a circular columnar space and opens forward. The cavity 28 communicates with an ambient atmosphere via the through hole 27H.

In the above-mentioned ignition plug 1, electric power is input to a gap 29 formed between the center electrode 5 and the ground electrode 27, thereby generating plasma in the cavity 28. The generated plasma is discharged through the through hole 27H. Next will be described the configuration of the voltage application section 31 and the capacitance section 41, which supply electric power to the gap 29 of the ignition plug 1.

As shown in FIG. 1, the voltage application section 31 includes a primary coil 32, a secondary coil 33, a core 34, and an igniter 35.

The primary coil 32 is wound about the core 34; one end of the primary coil 32 is connected to a power supply battery VA; and the other end of the primary coil 32 is connected to the igniter 35. Also, the secondary coil 33 is wound about the core 34; one end of the secondary coil 33 is connected to a line extending between the primary coil 32 and the battery VA; and the other end of the secondary coil 33 is connected to the terminal electrode 6 of the ignition plug 1.

Additionally, the igniter 35 is formed of a predetermined transistor and switches ON and OFF power supply from the battery VA to the primary coil 32 according to an energization signal input from an unillustrated predetermined electronic control unit (ECU). When a high voltage is to be applied to the ignition plug 1, current is applied to the primary coil 32 from the battery VA to thereby form a magnetic field around the core 34; and then, the energization signal from the ECU is switched over from ON to OFF, thereby halting current from the battery VA to the primary coil 32. The halt of current causes a change in the magnetic field around the core 34. Thus, through self dielectric effect, a primary voltage is generated in the primary coil 32, and a high voltage (several kV to several tens of kV) of negative polarity is generated in the secondary coil 33. This high voltage is applied to the ignition plug 1 (the terminal electrode 6), thereby generating spark discharge across the gap 29.

Additionally, energy E (J) supplied from the voltage application section 31 to the gap 29 is determined so as to satisfy the relational expression $E\times0.05\leq0.5\times C\times V^2\leq E\times0.8$ (in the present embodiment, $E\times0.05\leq0.5\times C\times V^2\leq E\times0.3$), where V (V) is the dielectric breakdown voltage of the gap 29 (voltage required to generate spark discharge across the gap 29), and C (F) is the total of the capacitance of the capacitance section 41, which will be described later, and the capacitance of the ignition plug 1.

The capacitance section 41 is charged with electric power supplied from the voltage application section 31 (the secondary coil 33) and is adapted to supply the charged electric power to the gap 29 of the ignition plug 1. The capacitance section 41 includes electric cords 42 and 43 and a capacitor 44.

The electric cords 42 and 43 are configured such that a conductor (not shown) made of an electrically conductive metal is covered with an insulating coating (not shown) made of an insulating material. The electric cord 42 is connected at one end to a line extending between the ignition plug 1 and the secondary coil 33 and is connected at the other end to the capacitor 44. The electric cord 43 is connected at one end to the capacitor 44 and is grounded at the other end. That is, the capacitance section 41 is connected in parallel to the ignition plug 1. Each of the electric cords 42 and 43 has a very small capacitance.

The capacitor 44 is disposed between the electric cords 42 and 43 and is formed of a variable capacitor whose capacitance is variable. The capacitance of the capacitor 44 is controlled by a controller 45. The controller 45 measures the dielectric breakdown voltage of the gap 29 and adjusts the capacitance of the capacitor 44 on the basis of the measured dielectric breakdown voltage. Specifically, the controller 45 increases and decreases the capacitance of the capacitor 44 according to a decrease and increase in the dielectric breakdown voltage (e.g., when the dielectric breakdown voltage increases, the controller 45 decreases the capacitance of the capacitor 44). The dielectric breakdown voltage varies with various factors, such as operating conditions of the internal combustion engine EN and the magnitude of the gap 29. For example, when the gap 29 increases as a result of erosion of the center electrode 5, the dielectric breakdown voltage increases.

Furthermore, in the present embodiment, the capacitance of the capacitance section 41 (the sum of the capacitances of the electric cords 42 and 43 and the capacitance of the capacitor 44) is equal to or greater than the capacitance of the ignition plug 1. The capacitance of the capacitance section 41 can be changed through adjustment of, for example, the capacitance of the capacitor 44. The capacitance of the ignition plug 1 can be changed through adjustment of the facing area between and the distance between the center electrode 5 and the metallic shell 3 and the material of the insulator 2 (dielectric constant of the insulator 2).

While being specified to be equal to or greater than the capacitance of the ignition plug 1 as mentioned above, the capacitance of the capacitance section 41 is specified to be equal to or less than 500 pF.

Furthermore, the resistance R of a current path extending from the capacitance section 41 to the forward end of the center electrode 5 is specified to be 1Ω to 500Ω inclusive (more preferably, 1Ω to 50Ω inclusive).

In the present embodiment, the ignition system 101 is configured to have the controller 45 and such that the capacitor 44 is a variable capacitor. However, the ignition system 101 may be configured without use of the controller 45 and such that the capacitor 44 has a fixed capacitance.

Figure 3:
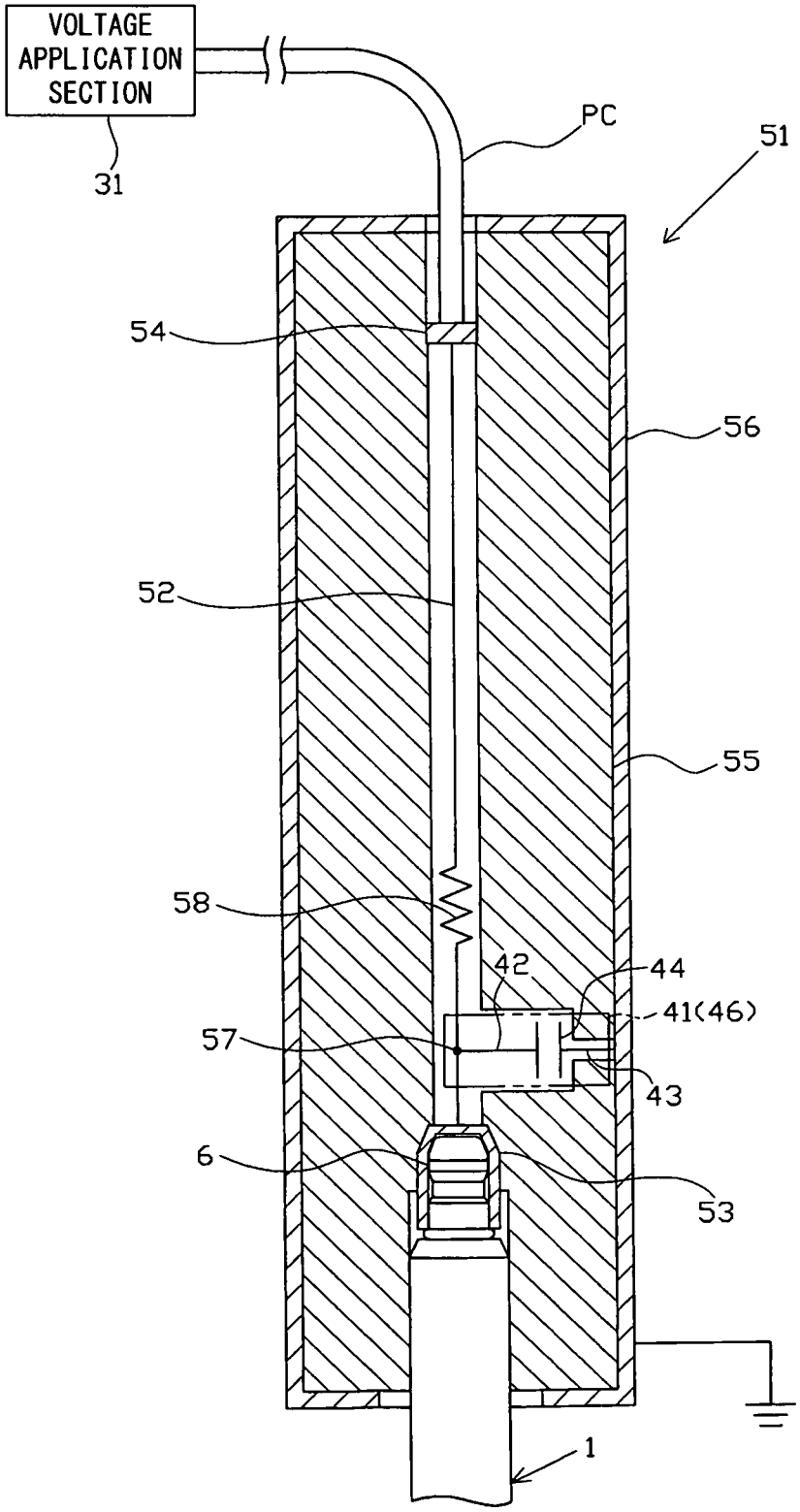
FIG. 3 is an enlarged schematic sectional view showing the configuration of a plug cap unit.

As shown in FIG. 3, the ignition system 101 may include a plug cap unit 51 connected to the ignition plug 1. The plug cap unit 51 has an electrical conductor 52 for electrically connecting the ignition plug 1 and a plug cord PC, to which voltage from the voltage application section 31 (the secondary coil 33) is applied. The capacitance section 41 includes a unit built-in section which has a capacitance equal to or greater than that of the ignition plug 1 and which is built into the plug cap 51 (in the present embodiment, the entire capacitance section 41 is disposed within the plug cap unit 51, and the capacitance section 41 serves as the unit built-in section 46). Additionally, the unit built-in section 46 (the capacitance section 41) is connected at one end (the electric cord 42) to the electrical conductor 52. Notably, only a portion of the capacitance section 41 may be disposed within the plug cap unit 51 such that the portion of the capacitance section 41 serves as the unit built-in section 46.

Furthermore, the plug cap unit 51 includes a connector 53 to which the terminal electrode 6 of the ignition plug 1 is connected, and a cord connection 54 for connection to the plug cord PC. Also, the plug cap unit 51 internally has a covering member 55 formed of an insulating material (e.g., insulating rubber, such as silicone rubber or fluororubber, and insulating resin, such as fluororesin) and having an internal hollow space. The unit built-in section 46 is covered with the covering member 55, and the internal hollow space of the covering member 55 where the unit built-in section 46 is disposed is closed substantially in a hermetically sealed condition.

Additionally, the plug cap unit 51 has a tubular shield 56 made of an electrically conductive material (a material having an electrical resistivity of 10 μΩ·cm or less; for example, an electrically conductive metal, such as copper or aluminum, and an electrically conductive resin) and provided on its outer periphery. The shield 56 is disposed around the electrical conductor 52 and the unit built-in section 46. The shield 56 is grounded; thus, the unit built-in section 46 (the capacitance section 41) is connected at the other end (the electric cord 43) to the shield 56, thereby being grounded. The unit built-in section 46 may be directly grounded instead of being grounded at the other end via the shield 56. Also, the unit built-in section 46 may be grounded via the electric cord 43 by means of the electric cord 43 being grounded and the shield 56 being connected to the electric cord 43.

Furthermore, the distance between and the facing area between the shield 56 and the electrical conductor 52 and the dielectric constant of the covering member 55 are determined such that the capacitance between the shield 56 and the electrical conductor 52 is 25 pF or less.

Furthermore, a connection 57 where the capacitance section 41 is connected at one end to the electrical conductor 52 is disposed in the vicinity of an end portion of the electrical conductor 52 which is connected to the ignition plug 1 (i.e., in the vicinity of the connector 53). Additionally, a resistor 58 having a resistance of 500Ω or greater intervenes between the connection 57 and an end portion of the electrical conductor 52 which is connected to the plug cord PC (i.e., between the connection 57 and the cord connection 54). Notably, the expression "a connection 57 . . . is disposed in the vicinity of an end portion of the electrical conductor 52 which is connected to the ignition plug 1" means that the connection 57 is disposed on a side toward the ignition plug 1 (the connector 53) with respect to the middle of the electrical conductor 52. In the present embodiment, the resistor 58 is also disposed on the side toward the connector 53. More specifically, the resistor 58 is disposed on the side toward the connector 53 with respect to the middle of the electrical conductor 52.

Figure 4A:
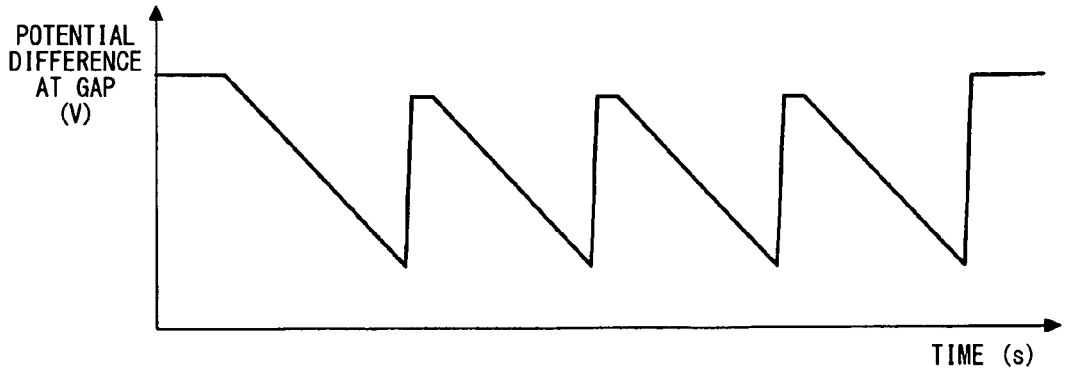
FIG. 4A is a waveform diagram showing the potential difference of a gap.
Figure 4B:
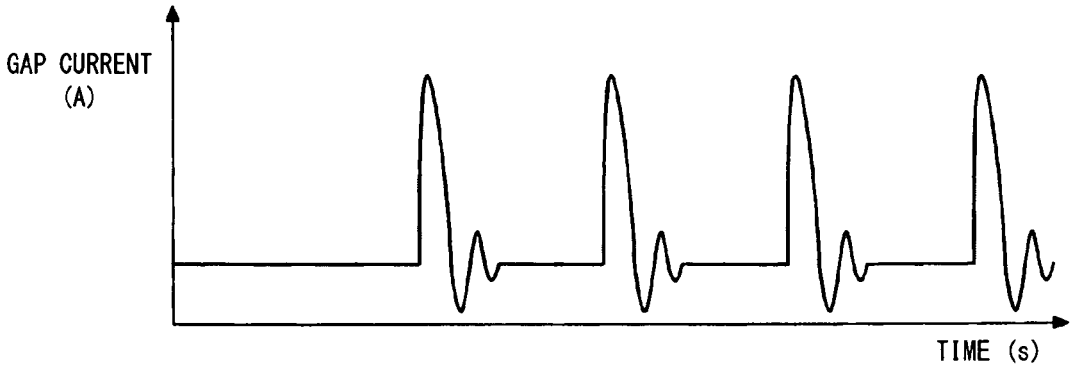
FIG. 4B is a waveform diagram showing current which flows through the gap.

Next, the operation of the above-mentioned ignition system 101 will be described. First, at predetermined ignition timing, an energization signal which the ECU sends to the igniter 35 is switched OFF, thereby generating a high voltage of negative polarity in the secondary coil 33 of the voltage application section 31. The voltage application section 31 supplies associated electric energy to the gap 29 (the electric energy is supplied continuously for a predetermined amount of time). By this procedure, as shown in FIG. 4A, the ignition plug 1 and the capacitance section 41 are supplied with charge, and the potential difference at the gap 29 increases. When the potential difference at the gap 29 exceeds the dielectric breakdown voltage of the gap 29, charge accumulated in the ignition plug 1 flows into the gap 29, and charge accumulated in the capacitance section 41 flows into the gap 29 in a slightly delayed fashion. As a result, as shown in FIG. 4B, capacitive discharge is generated across the gap 29, and a large current flows across the gap 29 (at this time, since a diode does not exist between the voltage application section 31 and the ignition plug 1, resonance occurs). When capacitive discharge is generated, the resistance of the gap 29 becomes very small, thereby establishing a state in which current is apt to flow into the gap 29 from the voltage application section 31. However, since the capacitance section 41 is provided in parallel with the ignition plug 1, current from the voltage application section 31 flows into the capacitance section 41, thereby being used to charge the capacitance section 41. Also, since the capacitance of the capacitance section 41 is equal to or greater than that of the ignition plug 1, charge which is supplied from the voltage application section 31 after capacitive discharge flows not only into the capacitance section 41 but also into the gap 29 and a capacitance region of the ignition plug 1. However, since charge flowing into the gap 29 reduces, a discharge path fails to be maintained. The resistance of the gap 29 increases. Then, the initial state is restored again, and only the capacitance section 41 and the ignition plug 1 are charged. Therefore, at the stage of completion of charging the capacitance section 41, the resistance of the gap 29 increases to a level equivalent to that before capacitive discharge, thereby restraining current from the voltage application section 31 and the capacitance section 41 from generating inductive discharge. As a result, only capacitive discharge is generated. Furthermore, since the ignition system 101 is configured to satisfy the relational expression $0.5\times C\times V^2 \leq E\times 0.3$, electric energy which is continuously supplied from the voltage application section 31 again supplies the ignition plug 1 and the capacitance section 41 with charge. Again, the following procedure is repeated while electric energy is supplied from the voltage application section 31: when the potential difference at the gap 29 exceeds the dielectric breakdown voltage of the gap 29, capacitive discharge is generated across the gap 29; then, the ignition plug 1 and the capacitance section 41 are charged. When the dielectric breakdown voltage changes as a result of, for example, erosion of the center electrode 5 stemming from repeated discharge, the controller 45 adjusts the capacitance of the capacitor 44 so as to satisfy the relational expression $E\times 0.05 \leq 0.5\times C\times V^2 \leq E\times 0.3$.

As described above in detail, according to the present embodiment, when the potential difference at the gap 29 exceeds the dielectric breakdown voltage of the gap 29, in addition to charge stored in the ignition plug 1, charge stored in the capacitance section 41 flows into the gap 29, thereby generating capacitive discharge. Therefore, current which flows in association with capacitive discharge can be increased, so that plasma formation efficiency can be improved.

Furthermore, since, upon generation of capacitive discharge, the resistance of the gap 29 drops, there is concern that current flows into the gap 29 from the voltage application section 31 with resultant generation of inductive discharge. However, according to the present embodiment, current from the voltage application section 31 flows into the capacitance section 41 for charging the capacitance section 41. Therefore, energy which is conventionally used for inductive discharge can be utilized as energy of the capacitance section 41 for use in capacitive discharge. As a result, a decrease in energy efficiency can be restrained, whereby plasma formation efficiency can be further improved.

Additionally, there is no need to employ an apparatus for inputting electric power and diodes for preventing current from flowing into the voltage application section, etc. Also, since the employment of diodes is unnecessary, a reduction in energy input to the gap 29 which would otherwise result from presence of diodes can be prevented.

As mentioned above, according to the present embodiment, the apparatus for inputting electric power and diodes can be eliminated. Also, even though the apparatus for inputting electric power is eliminated, by virtue of presence of the capacitance section 41 and elimination of diodes, plasma formation efficiency can be effectively improved. As a result, while production cost is greatly reduced, excellent ignition performance can be implemented.

Additionally, since the capacitance of the capacitance section 41 is specified to be equal to or greater than that of the ignition plug 1, at the time of completion of charging the capacitance section 41, capacitive discharge can be readily halted (i.e., upon completion of charging the capacitive section 41 and upon associated establishment of a state in which current from the voltage application section 31 and the capacitance section 41 can flow into the gap 29, the resistance of the gap 29 is more reliably restored to the original level). Thus, there can be more reliably prevented the flow of current into the gap 29 from the voltage application section 31 and the capacitance section 41 and associated generation of inductive discharge. Therefore, plasma formation efficiency can be further improved.

Furthermore, since the capacitance of the capacitance section 41 is specified to be 500 pF or less, discharge energy associated with discharge of charge accumulated in the capacitance section 41 can be sufficiently reduced. Therefore, thermal erosion or the like of the center electrode 5 associated with discharge can be restrained, so that durability can be improved.

Also, since the resistance R of the current path extending from the capacitance section 41 to the forward end of the center electrode 5 is 500Ω or less, charge stored in the capacitance section 41 flows into the gap 29 not a long time after charge stored in the ignition plug 1 has flowed into the gap 29. Thus, capacitive discharge can be more reliably generated by use of both of charge stored in the ignition plug 1 and charge stored in the capacitance section 41. As a result, current which flows in association with capacitive discharge can be more reliably increased, so that plasma formation efficiency can be further improved.

Furthermore, since the current path is specified to have a resistance of 1Ω or greater, an excessive increase in plasma discharge speed can be restrained, so that heat of plasma can be efficiently transmitted to the air-fuel mixture. As a result, the above-mentioned effect of improving ignition performance can be more reliably exhibited.

Additionally, electric energy ($0.5 \times C \times V^2$) which can be stored in the capacitance section 41 and the ignition plug 1 is specified to a value of 0.05 times to 0.3 times, inclusive, the energy E supplied from the voltage application section 31. Therefore, by use of energy of single supply, capacitive discharge can be more reliably generated a plurality of times (about three times to 20 times). As a result, plasma generation efficiency can be further effectively improved, and ignition performance can be further improved.

Also, since the ignition system 101 is configured such that the controller 45 can adjust the capacitance of the capacitor 44, electric energy which can be stored in the capacitance section 41 can be sufficiently smaller than the energy E supplied from the voltage application section 31, irrespective of operating conditions of the internal combustion engine EN and the magnitude of the gap 29. Thus, capacitive discharge can be more reliably generated, and the occurrence of misfire can be prevented. Also, by use of the energy E of single supply from the voltage application section 31, capacitive discharge can be more reliably generated a plurality of times. Thus, ignition performance can be further improved.

Furthermore, by means of the capacitance section 41 (the unit built-in section 46) being provided within the plug cap unit 51, and the unit built-in section 46 being covered with the covering member 55 made of an insulating material, deterioration in insulating properties of the unit built-in section 46 which would otherwise result from adhesion of, for example, dust and water droplets can be restrained. As a result, current leakage from the unit built-in section 46 can be more reliably prevented, and loss in energy supplied to the ignition plug 1 can be effectively restrained, Additionally, by means of the shield 56 being disposed around the unit built-in section 46 and the electrical conductor 52, there can be more reliably prevented outward release of noise generated when charge stored in the capacitance section 41 flows into the ignition plug 1.

Also, by means of the capacitance between the shield 56 and the electrical conductor 52 being 25 pF or less, noise generated when charge stored between the shield 56 and the electrical conductor 52 flows into the ignition plug 1 can be sufficiently reduced. As a result, the noise-restraining effect yielded through provision of the shield 56 can be more reliably exhibited.

Furthermore, by means of the resistor 58 being provided between the connection 57 of the electrical conductor 52 and the capacitance section 41, and an end portion of the electrical conductor 52 on a side toward the plug cord PC, there can be restrained upward propagation (propagation toward the voltage application section 31) of noise which is generated in the ignition plug 1 in association with capacitive discharge, so that the noise-restraining effect can be further enhanced. Also, the presence of the resistor 58 in the vicinity of the ignition plug 1 can prevent most of charge stored between the shield 56 and the electrical conductor 52 from flowing into the ignition plug 1. As a result, the noise-restraining effect can be further improved.

Figure 5A:
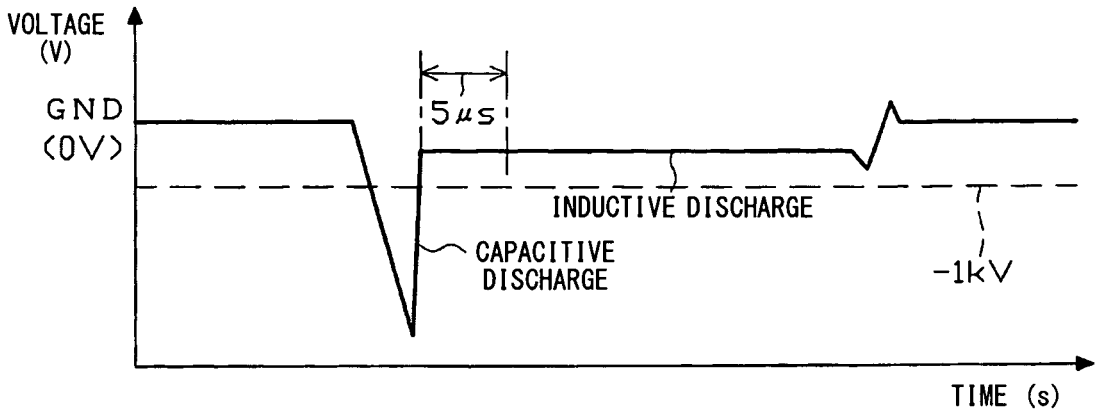
FIG. 5A is a waveform diagram showing an example discharge waveform in the case of occurrence of inductive discharge.
Figure 5B:
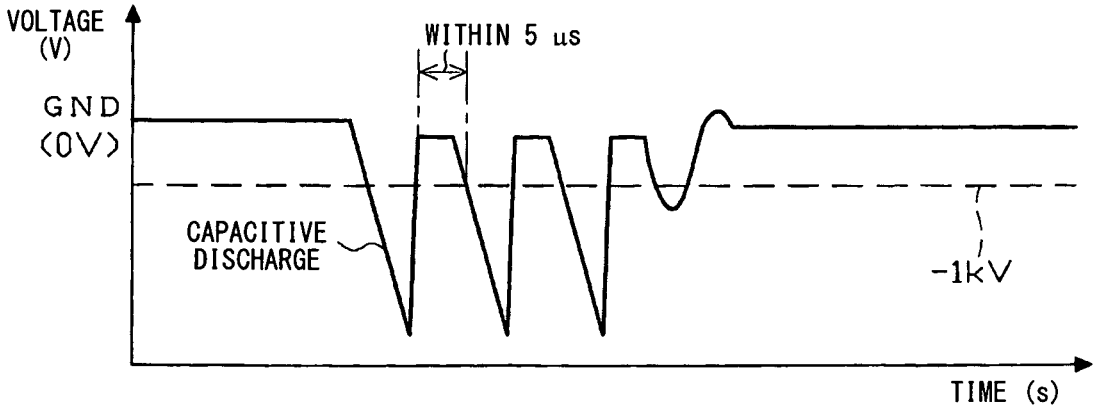
FIG. 5B is a waveform diagram showing an example discharge waveform in the case of no occurrence of inductive discharge.
Figure 6:
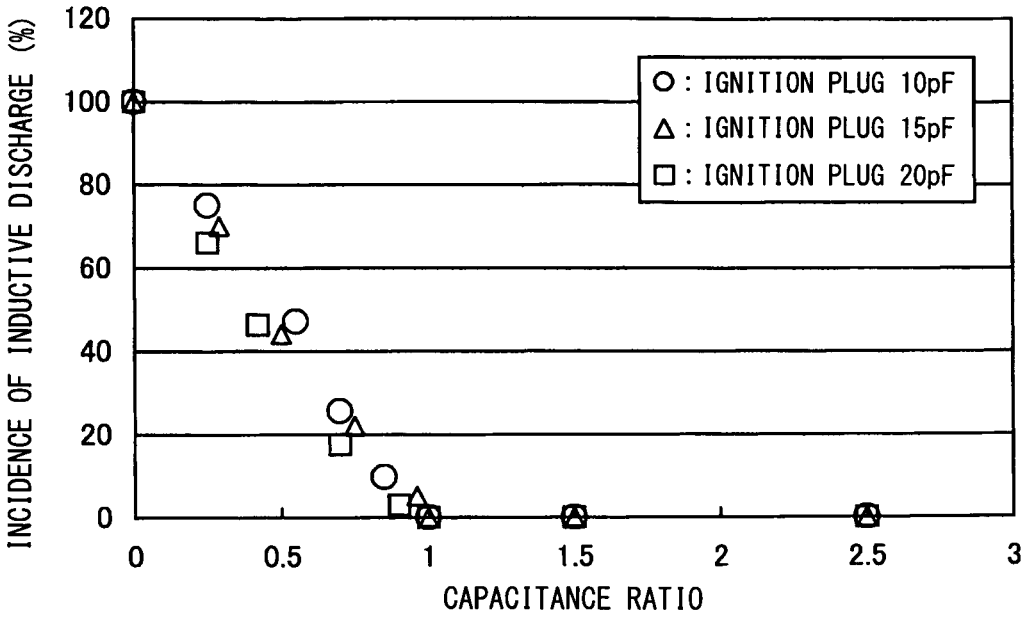
FIG. 6 is a graph showing the relationship between the capacitance ratio and the incidence of inductive discharge.

Next, in order to verify actions and effects which the above-described embodiment yields, there were manufactured a plurality of ignition system samples which differed in the capacitance of the capacitance section while having a capacitance of an ignition plug of 10 pF, 15 pF, or 20 pF. The samples were subjected to an inductive discharge measurement test. The outline of the inductive discharge measurement test is as follows. While the voltage across the gap of the ignition plug was measured, spark discharge was generated 100 times across the gap. For example, as shown in FIG. 5A, in the case where the voltage across the gap did not drop below −1 kV within 5 μs after dielectric breakdown, it was judged that inductive discharge was generated subsequent to capacitive discharge. For example, as shown in FIG. 5B, in the case where the voltage across the gap dropped below −1 kV within 5 μs after dielectric breakdown, it was judged that inductive discharge was not generated. The number of inductive discharges was counted in the course of 100 spark discharges, and the ratio of inductive discharges to spark discharges (incidence of inductive discharge) was calculated. FIG. 6 is a graph showing the relationship between the incidence of inductive discharge and the ratio of the capacitance of the capacitance section to the capacitance of the ignition plug (capacitance ratio). In FIG. 6, the test results of the samples having a capacitance of the ignition plug of 10 pF are plotted with circles; the test results of the samples having a capacitance of the ignition plug of 15 pF are plotted with triangles; and the test results of the samples having a capacitance of the ignition plug of 20 pF are plotted with squares. Also, a capacitance ratio of zero means that the capacitance section was not provided. Every sample had a resistance of 5Ω between the capacitor and the forward end of the center electrode and employed a CDI as the voltage application section. The capacitance of the ignition plug was varied through adjustment of, for example, the material of the insulator and the facing area between the metallic shell and the center electrode. The capacitance of the capacitance section was varied through adjustment of the capacitance of the capacitor.

As shown in FIG. 6, the samples having a capacitance ratio of 1.0 or greater (i.e., the capacitance of the capacitance section is equal to or greater than that of the ignition plug) exhibit an incidence of inductive discharge of 0%, indicating that supplied energy is very efficiently used for capacitive discharge. Conceivably, this is for the following reason: since charging the capacitance section consumed time, at the time of completion of charging the capacitance section, capacitive discharge was halted; eventually, flow of current into the gap from the voltage application section, etc., subsequent to capacitive discharge was prevented.

As can be understood from the above test results, preferably, in order to improve plasma formation efficiency through efficient utilization of energy supplied from the voltage application section for generation of capacitive discharge, the capacitance of the capacitance section is equal to or greater than that of the ignition plug.

Figure 7:
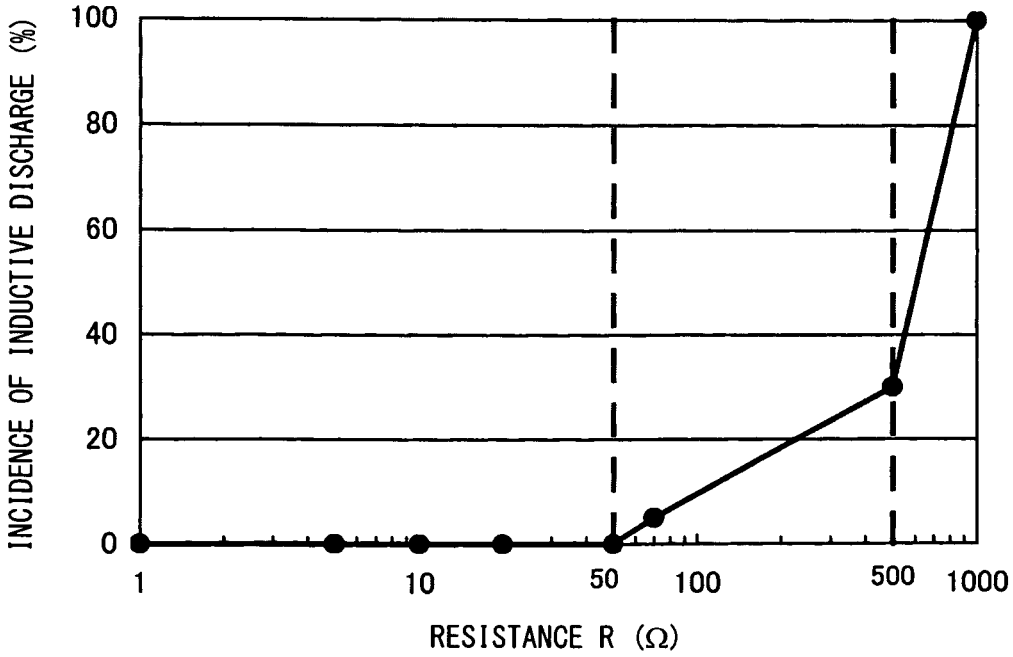
FIG. 7 is a graph showing the relationship between the resistance R and the incidence of inductive discharge.

Next, there were manufactured a plurality of ignition system samples which differed in the resistance R (Ω) between the capacitance section and the forward end of the center electrode. The samples were subjected to the above-mentioned inductive discharge measurement test. FIG. 7 is a graph showing the relationship between the resistance R and the incidence of inductive discharge. In the test, the capacitance of the capacitance section was 100 pF, and the capacitance of the capacitance section was equal to or greater than that of the ignition plug.

As shown in FIG. 7, the samples having a resistance R of 500Ω or less exhibit a sufficiently low incidence of inductive discharge, indicating that supplied energy is efficiently utilized for generation of capacitive discharge. Conceivably, this is for the following reason: charge stored in the capacitance section flowed into the gap not a long time after charge stored in the ignition plug had flowed into the gap, so that charge of the capacitor was more reliably used for capacitive discharge. Particularly, it has been confirmed that employment of a resistance R of 50Ω or less can very effectively restrain the generation of inductive discharge.

As can be understood from the above test results, in view of further improvement of ignition performance through more efficient utilization of energy supplied from the voltage application section for generation of capacitive discharge, the resistance R of an electrically conductive path from the capacitance section to the center electrode is preferably 500Ω or less, more preferably 50Ω or less.

Figure 8:
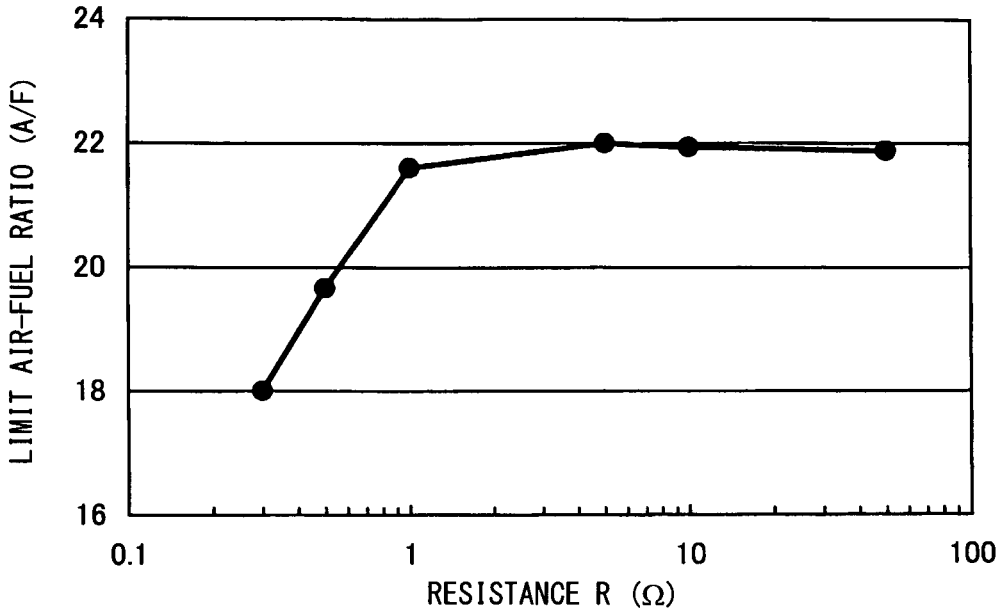
FIG. 8 is a graph showing the relationship between the resistance R and the limit air-fuel ratio.

Next, the ignition system samples which differed in the resistance R were subjected to an ignition performance evaluation test. The outline of the ignition performance evaluation test is as follows. The samples were mounted to a 4-cylinder engine of 2.0 L displacement. The engine was operated at a speed of 1,600 rpm with ignition timing set to MBT (Minimum Spark Advance for Best Torque). While the air-fuel ratio was being gradually increased (the fuel content was being reduced), the variation rate of engine torque was measured in relation to the air-fuel ratio. An air-fuel ratio at which the variation rate of engine torque exceeded 5% was obtained as a limit air-fuel ratio. The higher the limit air-fuel ratio, the better the ignition performance. FIG. 8 shows the results of the test. In the test, the capacitance of the capacitance section was 100 pF, and the capacitance of the capacitance section was equal to or greater than that of the ignition plug.

As shown in FIG. 8, the samples having a resistance R of less than 1Ω have been found to suffer deterioration in ignition performance. Conceivably, this is for the following reason: as a result of the resistance R being excessively low, inputting time of electric power to the gap from the ignition plug and the capacitance section became excessively short. As a result, the plasma discharge speed increased significantly, causing a failure to sufficiently transmit heat of plasma to the air-fuel mixture.

By contrast, it has been confirmed that the samples having a resistance R of 1Ω or greater can implement excellent ignition performance.

As can be understood from the above test results, preferably, in order to more reliably improve ignition performance, the resistance R is 1Ω or greater.

Figure 9:
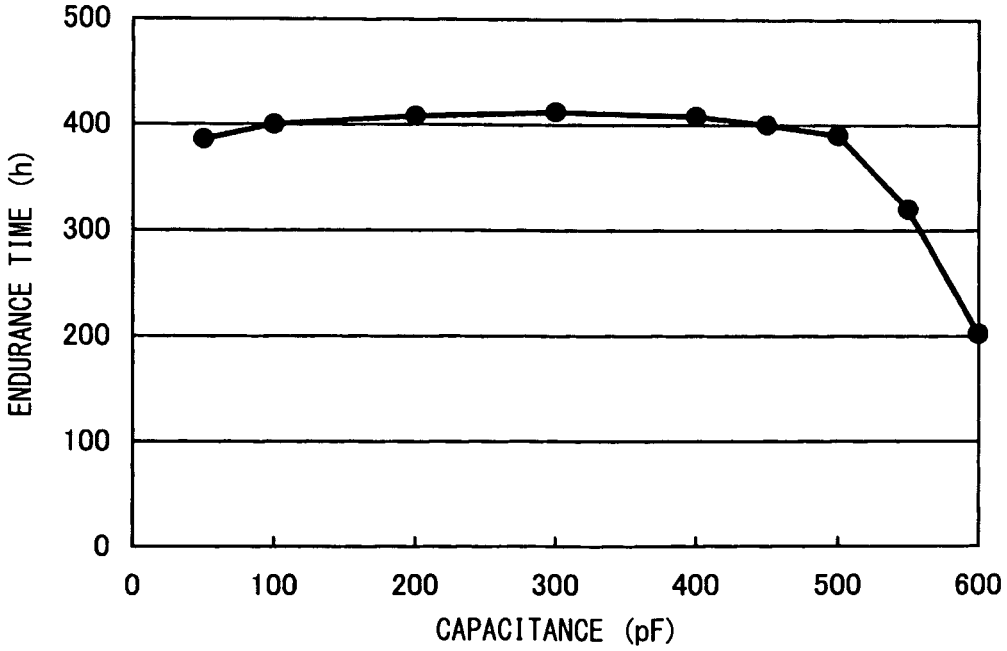
FIG. 9 is a graph showing the relationship between the endurance time and the capacitance of a capacitance section.

Next, the ignition system samples which differed in capacitance of the capacitance section were subjected to a durability evaluation test. The outline of the durability evaluation test is as follows. The ignition plugs of the samples were mounted to a predetermined chamber. The ignition plugs were caused to discharge under the following conditions: a chamber pressure of 0.4 MPa; a standard gas atmosphere within the chamber; and a frequency of applied voltage of 60 Hz (i.e., the samples discharged 3,600 times per minute). Time that had elapsed, from the start of discharge, until the volume of erosion of the center electrode reached 1 $mm^3$ (endurance time) were measured. FIG. 9 shows the results of the test. The energy E supplied to the gap from the voltage application section was 70 mJ, and the center electrode had an electrode tip made of W at its forward end portion.

As shown in FIG. 9, it has been found that, in the case of a capacitance of the capacitance section in excess of 500 pF, erosion of the center electrode abruptly progresses. Conceivably, this is for the following reason: discharge energy associated with spark discharge increased. As a result, the center electrode was apt to suffer thermal erosion or the like.

By contrast, in the case of a capacitance of the capacitance section of 500 pF or less, endurance time becomes sufficiently long; specifically, about 400 hours, indicating that durability is excellent.

As can be understood from the above test results, in view of maintenance of excellent ignition performance over a long period of time through improvement of durability, preferably, the capacitance of the capacitance section is 500 pF or less.

Figure 10:
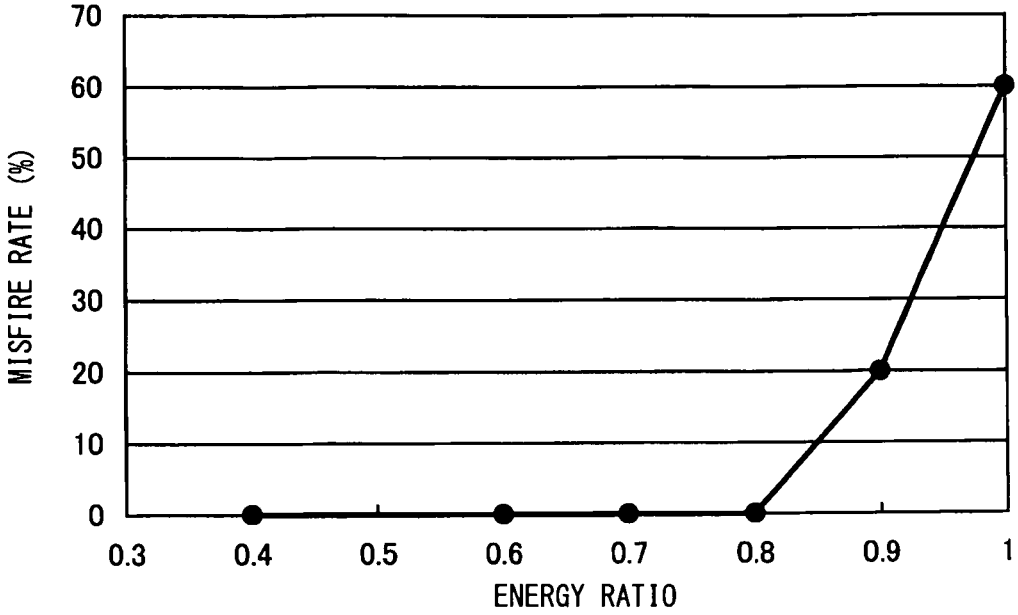
FIG. 10 is a graph showing the relationship between the energy ratio and the misfire rate.

Next, there were prepared ignition system samples which differed in the value of $(0.5\times C\times V^2)/E$ (energy ratio) as effected through adjustment of the dielectric breakdown voltage V (V) of the gap and the total C (F) of the capacitance of the capacitance section and the capacitance of the ignition plug while having an energy E of 70 mJ supplied to the gap from the voltage application section. The samples were subjected to a misfire rate measurement test. The outline of the misfire rate measurement test is as follows. Electric energy was supplied 100 times to the gap from the voltage application section; a discharge waveform (voltage across the gap) associated with supply of electric energy was observed; and the rate of occurrence of a misfire waveform (a waveform whose voltage attenuation time is longer than in a normal case) was measured (i.e., the misfire rate was measured). FIG. 10 shows the results of the test.

As shown in FIG. 10, the samples having an energy ratio of 0.8 or less (i.e., the samples which satisfy the relational expression $0.5\times C\times V^2$ E×0.8) are free of occurrence of misfire waveforms, indicating that spark discharge can be more reliably generated. Conceivably, this is for the following reason: since electric energy storable in the capacitance section and the ignition plug was rendered sufficiently small relative to supply energy of the voltage application section, the ignition plug could be supplied with sufficient charge.

As can be understood from the above test results, preferably, in order to reliably exhibit the effect of improving ignition performance, the supply energy E of the voltage application section, the capacitance of the capacitance section, etc., are adjusted so as to satisfy the relational expression $0.5\times C\times V^2 \leq E\times 0.8$.

Figure 11:
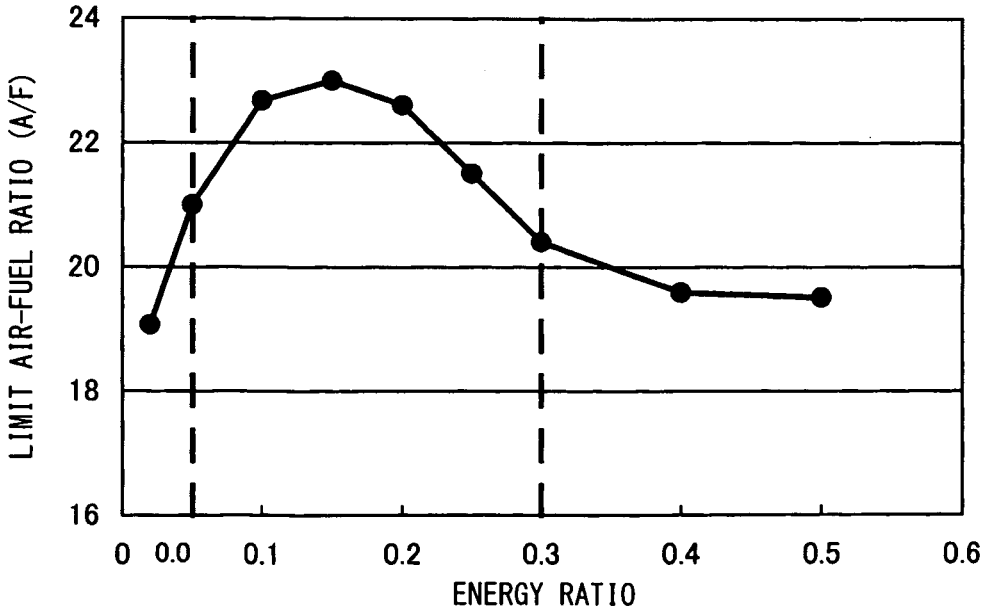
FIG. 11 is a graph showing the relationship between the energy ratio and the limit air-fuel ratio.

Next, the ignition system samples which differed in the above-mentioned energy ratio were subjected to the above-mentioned ignition performance evaluation test. FIG. 11 shows the results of the test. Notably, the ignition performance evaluation test was conducted on a sample having no capacitance section and revealed that the sample had a limit air-fuel ratio of 17.5.

As shown in FIG. 11, every sample exhibited excellent ignition performance as compared with the sample having no capacitance section. Particularly, the samples having an energy ratio of 0.05 to 0.3 inclusive (i.e., the samples which satisfy the relational expression $E\times 0.05 \leq 0.5\times C\times V^2 \leq E\times 0.3$) have been found to be quite excellent in ignition performance. Conceivably, this is for the following reason: through employment of an energy ratio of 0.05 to 0.3, by use of energy of single supply from the voltage application section, capacitive discharge could be generated a plurality of times; eventually, plasma formation efficiency was further improved.

As can be understood from the above test results, preferably, in order to further improve ignition performance, the supply energy E of the voltage application section, the capacitance of the capacitance section, etc., are adjusted so as to satisfy the relational expression $E\times 0.05 \leq 0.5\times C\times V^2 \leq E\times 0.3$.

Figure 12:
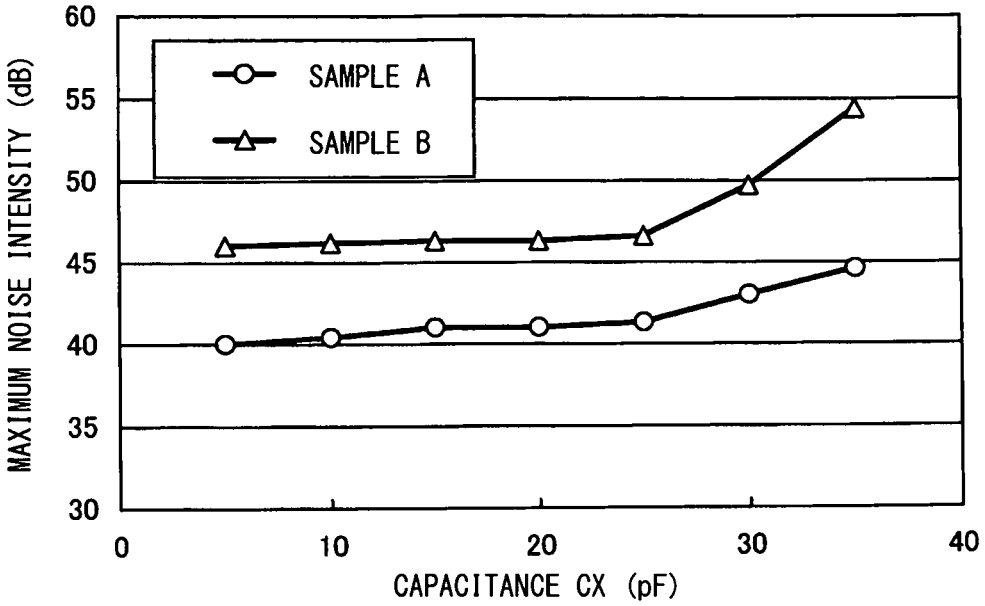
FIG. 12 is a graph showing the results of a noise evaluation test on samples which differ in capacitance between a shield and an electrical conductor.

Next, there were manufactured ignition system samples A which differed in capacitance CX (pF) between the electrical conductor and the shield of the plug cap unit while having a 500Ω resistor in the electrical conductor, and samples B which differed in the capacitance CX (pF) while having no resistor in the electrical conductor. The samples A and B were subjected to a noise evaluation test. The outline of the noise evaluation test is as follows. By use of a predetermined EMI measuring apparatus (GTEM-LT 500, product of Schaffner), the ignition plugs were caused to discharge in a measuring range of 30 MHz to 1,000 MHz, and the samples were measured for the maximum intensity of noise generated in association with discharge (maximum noise intensity). FIG. 12 shows the results of the noise evaluation test. In FIG. 12, the test results of the samples A having the resistor are plotted with circles, whereas the test results of the samples B having no resistor are plotted with triangles. Every sample had a capacitance of the ignition plug of 15 pF and a capacitance of the capacitance section of 100 pF.

As shown in FIG. 12, it has been found that, through employment of a capacitance of 25 pF or less between the shield and the electrical conductor, excellent noise-restraining effect can be implemented. Conceivably, this is for the following reason: by means of capacitance storable between the shield and the electrical conductor being sufficiently reduced, at the time of capacitive discharge, noise generated in association with flow of charge stored between the shield and the electrical conductor into the ignition plug is reduced. As a result, the shield can sufficiently exhibit the noise shield effect.

Also, the samples A having the resistor in the electrical conductor have been found to have a quite excellent noise-restraining effect. Conceivably, this is for the following reason: the presence of the resistor restrained charge stored between the shield and a portion of the electrical conductor located upstream of the resistor from flowing into the ignition plug, and restrained upstream propagation of noise generated in the ignition plug in association with capacitive discharge.

As can be understood from the above test results, preferably, in order to implement excellent noise-restraining effect, the capacitance between the shield and the electrical conductor is 25 pF or less, and the resistor is provided in the electrical conductor.

Notably, if the resistor is provided in the electrical conductor at a position located downstream of the connection between the electrical conductor and the capacitive section, energy input to the ignition plug from the capacitance section may be hindered. Therefore, preferably, the resistor is provided in the electrical conductor at a position located upstream of the connection.

The present invention is not limited to the above-described embodiment, but may be embodied, for example, as follows. Of course, applications and modifications other than those exemplified below are also possible.

(a) In the above embodiment, the capacitance section 41 has a single capacitor 44. However, the capacitance section may have two or more capacitors connected in parallel.

(b) In the above embodiment, the capacitance section 41 has the capacitor 44. However, the capacitance section does not necessarily have the capacitor 44, so long as the capacitance section is connected in parallel to the ignition plug 1 and has capacitance. Therefore, for example, for use as the capacitance section, there may be employed an electric cord which is connected at one end to a line between the voltage application section 31 and the ignition plug 1 and grounded at the other end and which has a sufficient length for increasing capacitance.

(c) In the above embodiment, the voltage application section 31 is provided for each of the ignition plugs 1. However, it is not necessary for the voltage application section 31 to be provided for each of the ignition plugs 1. Electric power from the voltage application section 31 may be supplied to the ignition plugs 1 via a distributor.

(d) In the above embodiment, the ground electrode 27 is formed of W, Ir, or a like metal. However, only an inner circumferential region of the ground electrode 27 which is eroded in association with spark discharge may be formed of W, Ir, or a like metal.

(e) In the above embodiment, the center electrode 5 has the electrode tip 5C at its forward end portion. However, the center electrode 5 may be configured without provision of the electrode tip 5C.

DESCRIPTION OF REFERENCE NUMERALS

1: plasma jet ignition plug (ignition plug);
5: center electrode;

27: ground electrode;
28: cavity;
29: gap;
31: voltage application section;
41: capacitance section;
44: capacitor;
45: controller;
46: unit built-in section;
51: plug cap unit;
52: electrical conductor;
55: covering member;
56: shield;
57: connection;
58: resistor;
101: ignition system for plasma jet ignition plug (ignition system); and
PC: plug cord.

Having described the invention, the following is claimed:

1. An ignition system for a plasma jet ignition plug comprising:

a plasma jet ignition plug having a center electrode, a ground electrode, and a cavity surrounding at least a portion of a gap formed between the center electrode and the ground electrode to form a discharge space;

a voltage application section for applying voltage across the gap, wherein the voltage is supplied to the gap solely by said voltage application section;

a plug cap unit having an electrical conductor electrically connecting the plasma jet ignition plug and a plug cord to which voltage from the voltage application section is applied and that is connected to the plasma jet ignition plug;

a capacitance section having a capacitance and provided in parallel with the plasma jet ignition plug, said capacitance section comprising:

an electrical conductor that is electrically connected to both the plasma jet ignition plug and the voltage application section at a location between the plasma jet ignition plug and the voltage application section, and a unit built-in section having a capacitance equal to or greater than that of the plasma jet ignition plug, the unit built-in section built into the plug cap unit, wherein the capacitance section is connected at one end to the electrical conductor of the plug cap unit and is grounded at the other end; and a shield formed of a conductive material, said shield is grounded and disposed around the unit built-in section and the electrical conductor, wherein the shield and the electrical conductor have a capacitance of 25 pF or less between the shield and the electrical conductor.

2. An ignition system for a plasma jet ignition plug according to claim 1, wherein the capacitance section has a capacitance equal to or greater than that of the plasma jet ignition plug.

3. An ignition system for a plasma jet ignition plug according to claim 1, wherein the capacitance section has a capacitor electrically connected to said electrical conductor.

4. An ignition system for a plasma jet ignition plug according to claim 1, wherein the capacitance section has a capacitance of 500 pF or less.

5. An ignition system for a plasma jet ignition plug according to claim 1, wherein the ignition system has a current path having a resistance of 500Ω or less and extending from the capacitance section to a forward end of the center electrode.

6. An ignition system for a plasma jet ignition plug according to claim 1, wherein the ignition system has a current path having a resistance of 1Ω or greater and extending from the capacitance section to a forward end of the center electrode.

7. An ignition system for a plasma jet ignition plug according to claim 1, satisfying a relational expression $0.5\times C\times V^2\leq E\times 0.8$, where V (V) is a dielectric breakdown voltage of the gap, C (F) is the total of a capacitance of the capacitance section and a capacitance of the plasma jet ignition plug, and E (J) is energy supplied to the gap from the voltage application section.

8. An ignition system for a plasma jet ignition plug according to claim 1, satisfying a relational expression $E\times 0.05\leq 0.5\times C\times V^2\leq E\times 0.3$, where V (V) is a dielectric breakdown voltage of the gap, C (F) is the total of a capacitance of the capacitance section and a capacitance of the plasma jet ignition plug, and E (J) is energy supplied to the gap from the voltage application section.

9. An ignition system for a plasma jet ignition plug according to claim 1, wherein:

the capacitance section comprises a variable capacitor capable of varying its own capacitance, and the ignition system further comprises a controller capable of controlling the capacitance of the variable capacitor on the basis of a dielectric breakdown voltage of the gap.

10. An ignition system for a plasma jet ignition plug according to claim 1, wherein the unit built-in section is covered with a covering member formed of an insulating material.

11. An ignition system for a plasma jet ignition plug according to claim 1, wherein:

the capacitance section is connected at one end to the electrical conductor of the plug cap unit, and a connection between the electrical conductor of the plug cap unit and the one end of the capacitance section is disposed in the vicinity of an end portion of the electrical conductor of the plug cap unit which is connected to the plasma jet ignition plug, and a resistor having a resistance of 500Ω or greater intervenes between the connection and an end portion of the electrical conductor of the plug cap unit which is connected to the plug cord.

* * * * *